United States Patent [19]

Sykes

[11] Patent Number: 4,723,694

[45] Date of Patent: Feb. 9, 1988

[54] FLUID DISPENSING VALVE MECHANISM AND ASSEMBLY

[75] Inventor: Donald J. Sykes, Upper Saddle River, N.J.

[73] Assignee: Marpac Industries, Inc., Waldwick, N.J.

[21] Appl. No.: 903,263

[22] Filed: Sep. 3, 1986

[51] Int. Cl.[4] ..... B22D 37/00

[52] U.S. Cl. ..... 222/518; 251/149.1; 137/903

[58] Field of Search ..... 222/518, 512, 501, 511, 222/559; 401/147, 148, 264, 260, 273; 251/149.1, 149.2, 149.6; 167/DIG. 903

[56] References Cited

U.S. PATENT DOCUMENTS

| | | | |
|---|---|---|---|
| 2,212,567 | 8/1940 | Kirmes | 222/501 |
| 2,714,475 | 8/1955 | Roehrich | 222/501 |
| 2,957,610 | 10/1960 | Michel | 222/512 |
| 3,035,742 | 5/1962 | Cholet | 222/501 |

*Primary Examiner*—F. J. Bartuska
*Assistant Examiner*—Kenneth Noland
*Attorney, Agent, or Firm*—W. Patrick Quast

[57] ABSTRACT

A fluid dispensing valve mechanism including a valve body member having an annular seat portion which is contacted by the bushing portion of the shaft-bushing member to effect a seal. The shaft is interposed between the bushing and a contact point on a tower assembly, the latter held in fixed relationship to the valve body. The shaft, at least, is made from elastomeric material; and it is bowed off the axis between the center of the annular seat portion and the contact point on the tower assembly, when in position. This results in a positive seal between the bushing member and the annular seat. When the bushing member is displaced axially to dispense the fluid, the shaft member bows even further. The hysteresis effect inherent in the elastomeric shaft returns the bushing member to its contact position with the annular seat.

9 Claims, 4 Drawing Figures

FLUID DISPENSING VALVE MECHANISM AND ASSEMBLY

FIELD OF THE INVENTION

This invention relates to dispensing devices and in particular to a touch-activated, valve suitable for utilization with a wide variety of fluids.

BACKGROUND OF THE INVENTION

We are all familiar with touch-activated dispensing devices used, for example, in road side washrooms. These typically include a spring return, hand activated mechanism, which dispenses a predetermined, desirable amount of liquid, as for example hand washing soap, onto the user's palm.

In certain applications, where metallic parts are used in the dispensing mechanisms, the exposure to the liquid can precipitate corrosion unless stainless steel or other non-corrosive type materials are employed. These of course are relatively expensive. Alternately, to avoid the corrosion problem, the dispensing mechanism can be relatively complex, and thus costly, with the components housed in a separate chamber, or external to the liquid container.

In addition, for spring activated mechanisms where the coils of the spring, by design, are immersed in the liquid to be dispersed, a further problem can develop. In these situations the concentration of the liquid solution becomes a consideration.

Solubility is generally a function of the solvent and temperature. As the concentration of a solution increases, up to the limits of solubility for the particular solution, crystallization of the salt in solution can occur. The gap between the coils of the spring is possibly bridged by the crystallizing salt. This will increase the effort necessary to first open the valve; and subsequently slow down the mechanism return causing, perhaps, excessive leakage of the liquid.

It is therefore a primary object of this invention to provide a simple and uncomplicated dispensing valve mechanism which is largely impervious to the corrosive effects of liquid solutions.

It is yet another object of this invention to provide a valve mechanism which will function; notwithstanding that the concentration of the liquid solution is relatively high, thus accommodating a wide spectrum of liquids.

It is still another object of this invention to provide a valve mechanism which will function for a broad range of fluid materials, from dry powders to the more viscous liquids.

SUMMARY OF THE INVENTION

Towards the accomplishment of these and other objectives and advantages which will become apparent after considering the accompanying description and drawings, there is disclosed a fluid dispensing valve mechanism, for connection to a fluid container comprising a valve body member connectable to the fluid container; a shaft-bushing assembly; and a tower assembly. The valve body member includes an opening having an annular seat portion. The shaft-bushing assembly includes a bushing member having a cooperating surface portion for coacting with the annular seat portion of the valve body member to form a seal. The tower assembly has a center hub, contact portion axially aligned with the center of the annular seat portion of the valve body member. The shaft-bushing member includes a shaft portion extending between the bushing member and the contact portion on the tower assembly. The shaft member, at least, is fabricated from an elastomeric material and has a predetermined length such that when the bushing member is positioned against the annular seat portion and the shaft member contacts the contact portion of the tower assembly, the shaft member bows off of the axis line between the center of the annular seat portion and the contact portion of the tower assembly whereby the bushing member is positively urged against the annular seat portion to effect a tighter seal. The bushing member is axially displaceable from contact against the annular seat portion when force is applied thereto enabling fluid to flow out through the opening. The shaft member bows further off the axis line when the bushing member is axially displaced so that the hysteresis effect causes the bushing member to return to the contact position with the annular seat portion when the displacement force is removed.

The shaft member at least is made of elastomeric material; or the combination of shaft and bushing member. Also the tower assembly and shaft-bushing assembly can all be molded from the same elastomeric material. The Shore hardness of the elastomeric material can be adjusted to accommodate the application.

BRIEF DESCRIPTION OF THE DRAWINGS

A better understanding of the present invention will be had after a reading of the following description taken together with the accompanying drawings comprising.

DESCRIPTION OF THE PREFERRED EMBODIMENT

Figure 1:
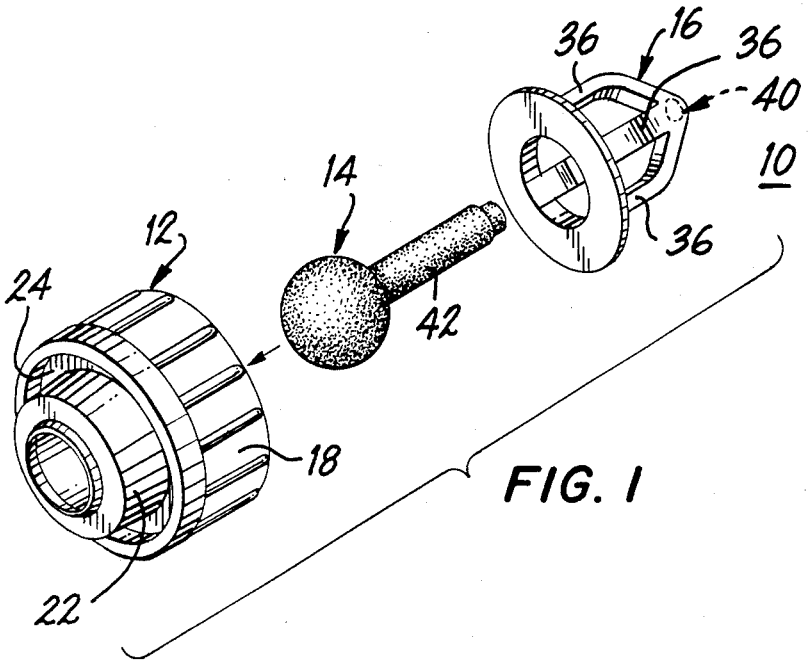
FIG. 1, which is an exploded view of the present invention, in perspective.

Referring to FIG. 1, the dispensing valve assembly of the present invention 10 is seen to include a valve body member 12; a shaft-bushing member 14; and a tower assembly 16.

The valve body assembly 12, formed of molded plastic includes a cylindrical cap portion 18 extending axially a distance along longitudinal axis 19. It includes an internally threaded portion 20 which engages the threaded neck of a liquid container (see for example FIG. 3.).

Also concentric about axis 19 and the cylindrical cap portion 18 is an essentially, cylindrically-shaped valve seat portion 22 which is connected to the cylindrical cap portion 18 by annular flange member 24. The cylindrically-shaped valve seat member 22 includes an annular seat portion 26 which is tapered from a first, larger diameter 28 to a second smaller diameter 30.

Annular flange portion 24 includes a concentric, annular ridged portion 32 which is used to concentrically align tower assembly 16 during the final assembly.

Tower assembly 16 for the embodiment shown is likewise made of molded plastic and includes an annular flange member 34. A plurality of axially extending ribs 36 are formed to extend at right angles essentially to the plane of flange member 34, a certain distance before bending radially inward toward axis 19 and toward a center hub 38 to form a concentric opening 40.

As noted above in the final assembly, the flange member 34 is positioned on annular flange 24. Ridge 32 aligns the tower flange 34 such that the center of opening 40 is substantially along axis 19 as is the center of the opening formed by annular seat portion 26. The contacting surfaces of flange member 34 and 24 can be ultrasonically welded to each other to form a composite assembly which is easily stored until subsequently used with various types of liquid containers.

Interposed between the tower assembly 16 and the valve body 12 is the shaft-bushing assembly 14. Obviously this is put in place within the tower before the flanges of the tower and valve body are secured to each other.

The shaft-bushing assembly 14 typically is a molded elastomeric material which is chemically inert in the liquid environment to be used. The shaft-bushing assembly includes an axially extending shaft 42 having a locating stub end 44 axially extending from surface 46 of the shaft 42. In final assembly, this stub end 44 is positioned in the concentric opening 40.

The other end of shaft 42 terminates in a bushing member 48, here shown spherical in shape, which is also aligned along axis 19 and which contacts with the annular seat portion 26 in final assembled from to provide a seal. Although shown spherical in the various embodiments depicted, generally the only surface shape of critical importance is in fact the surface of the bushing which contacts the annular valve seat 26. This surface is designed to provide the most effective liquid seal at this point.

Figure 2:
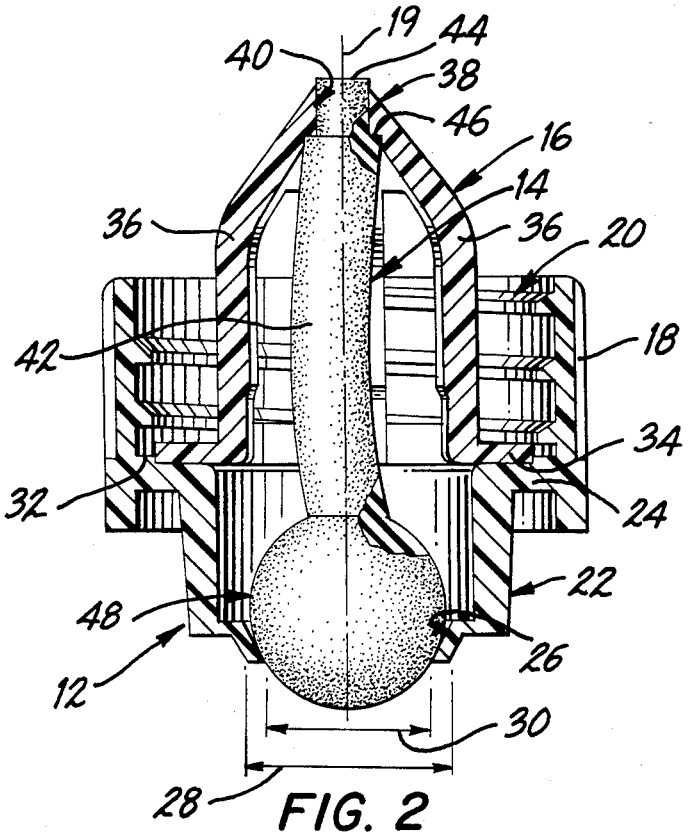
FIG. 2, which is an elevation view, partially in section of a first embodiment of the present invention.

As can be seen from FIG. 1, the natural orientation of shaft 42 is straight. However, its length is such that when interposed between the tower assembly and the valve body assembly as occurs when the unit is finally put together, a bowing of the shaft occurs as apparent in FIG. 2. This bowing results in a positive urging of the bushing member 48 against the annular seat portion 26. Thus an affirmative, effective seal at the contact point results.

Figure 3:
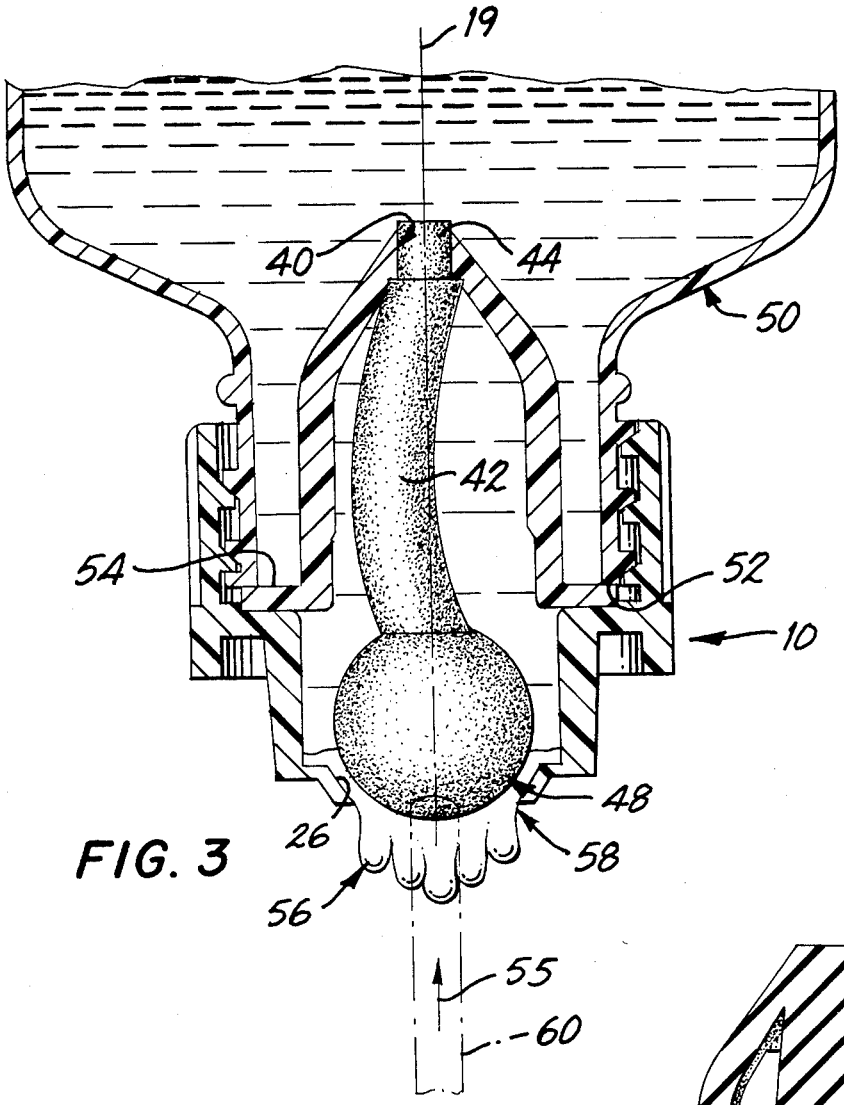
FIG. 3, which is an elevation view, in section, of the valve mechanism of the present invention secured to the neck of a liquid containing container; and, FIG. 4, which is an elevation view, partially in section of another embodiment of the present invention.

FIG. 3 shows the dispensing valve assembly 10 threaded onto a liquid containing vessel 50. The valve assembly 10 is threaded on such that the annular surface 52 of the neck of the containing vessel contacts surface 54 of flange member 34 thus providing a liquid seal. Once assembled to the liquid containing vessel, the combination is inverted to thus permit the liquid when dispensed, to flow out under the force of gravity.

As depicted in FIG. 3, for purposes of the following discussion the orientation of the assembly is vertical with the liquid containing vessel 50 above the valve assembly 10. In operation, a force is applied to bushing 48 by, for example, a finger or palm of the user's hand, which includes an upward axially component exerted in the direction of arrow 55. Since end 44 of shaft 42 is captured in opening 40, the shaft bows further off the axis 19, as shown, with the bushing 48 moving axially upward thus allowing liquid 56 to flow out around the bushing and out of the container at opening 58. When the user is finished, the finger or other force applying member is removed from contact with the bushing. The inherent hysteresis in the elastomeric shaft member 42 urges it to realign along axis 19 thus returning the bushing member to a positive sealing position with annular seat portion 26.

Depicted in phantom, at 60, is an axially extending member. This maybe integrally, elastomerically molded with the shaft bushing member; or, comprise a separate member, for example, a plastic molded member, positioned in a corresponding receiving notch in bushing 48. This extending member can permit remote activation of the bushing which may be helpful in certain applications, for example, where the liquid must be dispensed into a resevoir which might otherwise be inaccessible to the user. Or the nature of the liquid in the container may be such as to potentially cause physical harm to the user if it contacts the skin surface.

Figure 4:
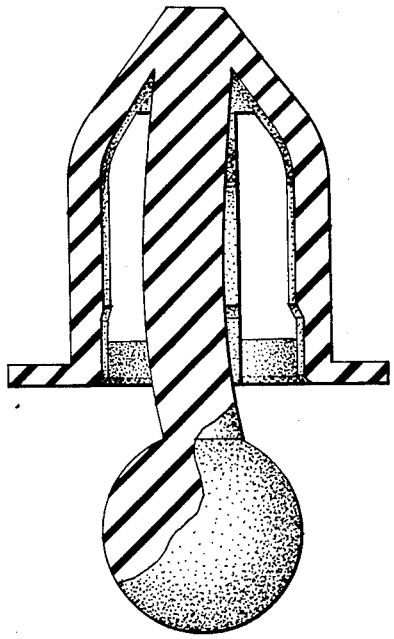

FIG. 4 depicts another embodiment of the tower assembly, shaft bushing combination. The general shape is the same; as is the length of the shaft component described earlier. Here, however, the combination is molded from the same elastomeric material providing an easier, manufactured and assembled unit.

Although the shaft bushing member has been described as comprising elastomeric material, alternatively the shaft alone can be formed of the elastomeric material and the one end thereof nested in a cooperative opening in a bushing member which is, perhaps, molded plastic or other material.

As mentioned earlier, the critical surface of the bushing 48 is the surface in contact with annular seat portion 26. This is shaped so as to optimize the seal between the two surfaces.

An inherent advantage of the embodiment employing an elastomeric bushing is that although certain organic solvents will cause certain elastomeric materials to swell, for example kerosene or kerosene type compounds, in the present design the fact of swelling of the bushing only results in a more positive and even tighter seal than otherwise.

The elastomeric material should have a Shore hardness which, of course, will enable the force applied in the direction 55 to effectively urge the bushing upward to as to permit the liquid to flow out for the container. For example, where the application calls for a person's finger or hand pressure to activate the bushing, a Shore hardness on the Shore A scale of between 40 to 80 would be suitable.

As is apparent from a study of the drawing, the plurality of rib members 36 which support end 44 of the shaft forms a cage which permits liquid flow from the container, "through" the cage, and out opening 58, which bushing member 48 is displaced upward.

While the above description uses the word "liquid" to describe typical application for the present invention, it is to be understood that the dispensing mechanism described herein has broad application to a wide range of fluid materials from dry powders to paste-like liquid mixtures such as hand soap.

Of course, after a reading of the above, other embodiments and alternative constructions to that described will now become obvious. Of course the present invention is not limited to the embodiments described but is rather defined by the scope of the claims which follow.

What is claimed is:

1. A fluid dispensing valve mechanism for connection to a fluid container comprising:

a valve body member including means for connecting to the fluid container;

a shaft-bushing assembly; and a tower assembly;

said tower assembly held in fixed relationship to said valve body member when said mechanism is assembled;

said valve body member including an opening having an annular seat portion;

said shaft-bushing assembly including a bushing member having a cooperating surface portion for coacting with said annular seat portion of said valve body member to form a seal;

said tower assembly having a center hub, contact portion axially aligned with the center of said annular seat portion of said valve body member;

said shaft-bushing member including a shaft portion extending between said bushing member and said contact portion on said tower assembly;

said shaft member, at least, fabricated from an elastomeric material and having a predetermined length such that when said bushing member is positioned against said annular seat portion and said shaft member contacts said contact portion of said tower assembly, said shaft member bows off of the axis line between the center of said annular seat portion and the contact portion of the tower assembly whereby said bushing member is positively urged against said annular seat portion to effect a seal;

said bushing member axially displaceable from contact against said annular seat portion when axial force is applied thereto whereby fluid is able to flow out through said opening, said shaft member bowing further off said axis line when said bushing member is axially displaced whereby said bushing member is returned to the contact position with said annular seat portion when said force is removed, wherein said shaft has a buckling length-to-thickness ratio and a predetermined axial spring rate, and wherein said tower assembly has axially extending ribs connected to an end of the shaft member opposite said bushing member so as to provide a hinged support for the shaft member.

2. A fluid dispensing system comprising:

a container for holding the fluid to be dispersed;

a dispensing valve mechanism means detachably connectable to said container;

said dispensing valve mechanism means including, a valve body member including means for connecting to the fluid container;

a shaft-bushing assembly; and a tower assembly;

said tower assembly held in fixed relationship to said valve body member when said mechanism is assembled;

said valve body member including an opening having an annular seat portion;

said shaft-bushing assembly including a bushing member having a cooperating surface portion for coacting with said annular seat portion of said valve body member to form a seal;

said tower assembly having a center hub, contact portion axially aligned with the center of said annular seat portion of said valve body member;

said shaft-bushing member including a shaft portion extending between said bushing member and said contact portion on said tower assembly;

said shaft member, at least, fabricated from an elastomeric material and having a predetermined length such that when said bushing member is positioned against said annular seat portion and said shaft member contacts said contact portion of said tower assembly, said shaft member bows off of the axis line between the center of said annular seat portion and the contact portion of the tower assembly whereby said bushing member is positively urged against said annular seat portion to effect a seal;

said bushing member axially displaceable from contact against said annular seat portion when axial force is applied thereto whereby fluid is able to flow out through said opening, said shaft member bowing further off said axis line when said bushing member is axially displaced whereby said bushing member is returned to the contact position with said annular seat portion when said force is removed, wherein said shaft has a buckling length-to-thickness ratio and a predetermined axial spring rate, and wherein said tower assembly has axially extending ribs connected to an end of the shaft member opposite said bushing member so as to provide a hinged support for the shaft member.

3. The valve mechanism of either claim 1 or claim 2 wherein both said shaft member and said bushing member are molded integrally from said elastomeric material.

4. The valve mechanism claimed in claim 3 wherein the Shore hardness of said elastomeric material, on the Shore A scale, is in the range between 40 and 80.

5. The valve mechanism claimed in claim 3 wherein said shaft member, said bushing member and said tower assembly are integrally molded from the same elastomeric material.

6. The valve mechanism claimed in claim 5 wherein the Shore hardness of said elastomeric material, on the Shore A scale, is in the range between 40 and 80.

7. The valve mechanism claimed in either claim 1 or claim 2 wherein the Shore hardness of said elastomeric material, on the Shore A scale, is in the range between 40 and 80.

8. The valve mechanism of either claim 1 or claim 2 wherein said shaft member and said tower assembly, at least, are integrally molded from the same elastomeric material, said shaft member extending axially from said center hub contact portion.

9. The valve mechanism claimed in either claim 1 or 2 further including force applying means fixedly secured to said bushing member and extending axially outward from said bushing member, in a direction opposite to the axial direction of said shaft portion, whereby a force can be applied to the bushing member for displacing it from contact against the annular portion.

* * * * *